US007972028B2

(12) United States Patent
Durand et al.

(10) Patent No.: US 7,972,028 B2
(45) Date of Patent: Jul. 5, 2011

(54) SYSTEM, METHOD AND TOOL FOR OPTIMIZING GENERATION OF HIGH CRI WHITE LIGHT, AND AN OPTIMIZED COMBINATION OF LIGHT EMITTING DIODES

(75) Inventors: Patrick Durand, Ottawa (CA); Muhamad Moussa, Montreal (CA)

(73) Assignee: Future Electronics Inc., Pointe-Claire, Quebec (CA)

( * ) Notice: Subject to any disclaimer, the term of this patent is extended or adjusted under 35 U.S.C. 154(b) by 198 days.

(21) Appl. No.: 12/262,791

(22) Filed: Oct. 31, 2008

(65) Prior Publication Data

US 2010/0110672 A1 May 6, 2010

(51) Int. Cl.
*F21V 9/00* (2006.01)

(52) U.S. Cl. ..... 362/231; 362/249.05

(58) Field of Classification Search ..... 362/231, 362/249.05, 249.13, 295, 394, 800; 356/121–123, 356/213, 218

See application file for complete search history.

(56) References Cited

U.S. PATENT DOCUMENTS 6,127,783 A 10/2000 Pashley et al.
6,150,774 A 11/2000 Mueller et al.
6,211,626 B1 4/2001 Lys et al.
6,234,645 B1 5/2001 Borner et al.
6,234,648 B1 5/2001 Borner et al.
6,340,868 B1 1/2002 Lys et al.
6,411,046 B1 6/2002 Muthu et al.
6,441,558 B1 8/2002 Muthu et al.
6,459,919 B1 10/2002 Lys et al.
6,495,964 B1 12/2002 Muthu et al.
6,507,159 B2 1/2003 Muthu et al.
6,513,949 B1 2/2003 Marshall et al.
6,528,954 B1 3/2003 Lys et al.
6,552,495 B1 4/2003 Chang et al.
6,576,881 B2 6/2003 Muthu et al.
6,692,136 B2 2/2004 Marshall et al.
6,788,011 B2 9/2004 Mueller et al.
6,930,452 B2 8/2005 De Krijger et al.
6,965,205 B2 11/2005 Piepgras et al.
6,992,803 B2 1/2006 Chang et al.
6,998,594 B2 2/2006 Gaines et al.
7,014,336 B1 3/2006 Ducharme et al.
7,064,498 B2 6/2006 Dowling et al.
7,135,824 B2 11/2006 Lys et al.
7,140,752 B2 11/2006 Ashdown et al.
7,161,311 B2 1/2007 Mueller et al.
7,161,313 B2 1/2007 Piepgras et al.
(Continued)

*Primary Examiner* — Bao Q Truong
(74) *Attorney, Agent, or Firm* — BCF LLP

(57) ABSTRACT

The present invention relates to a system, method and tool for optimizing combination of Light Emitting Diodes (LEDs), and to an optimized combination of LEDs. The system and method provide a plurality of LEDs and corresponding specifications. Then, a color temperature and a color rendering index are selected. Calculations are performed for subgroups of LEDs. At least one optimized combination of LEDs having an optimized corresponding luminous flux is identified according to selected color temperature, color rendering index and LEDs' specifications. In another aspect, the present invention relates to a tool for optimizing white light generated by a combination of LEDs. The tool comprises a repository for storing specifications for the combination of LEDs, a selection module for selecting at least one of the following parameters: a color temperature, a color rendering index and a maximum shift variance from a black body locus, and a processing module for calculating for subgroups of LEDs resulting color temperature, color rendering index, luminous flux, and for identifying an optimized selection of LEDs. The present invention also relates to an optimized combination of LEDs for producing white light with high color rendering index, the combination of LEDs excluding blue LEDs.

17 Claims, 8 Drawing Sheets

U.S. PATENT DOCUMENTS

| | | | | |
|---|---|---|---|---|
| 7,178,941 | B2 | 2/2007 | Roberge et al. | |
| 7,180,252 | B2 | 2/2007 | Lys et al. | |
| 7,186,003 | B2 | 3/2007 | Dowling et al. | |
| 7,202,613 | B2 | 4/2007 | Morgan et al. | |
| 7,204,622 | B2 | 4/2007 | Dowling et al. | |
| 7,255,457 | B2 | 8/2007 | Ducharme et al. | |
| 7,274,160 | B2 | 9/2007 | Mueller et al. | |
| 7,314,289 | B2 | 1/2008 | Montagne et al. | |
| 7,358,961 | B2 | 4/2008 | Zwanenburg et al. | |
| 7,385,359 | B2 | 6/2008 | Dowling et al. | |
| 7,387,405 | B2 | 6/2008 | Ducharme et al. | |
| 7,394,210 | B2 | 7/2008 | Ashdown et al. | |
| 7,423,387 | B2 | 9/2008 | Robinson et al. | |
| 2003/0133292 | A1* | 7/2003 | Mueller et al. | 362/231 |
| 2005/0040774 | A1 | 2/2005 | Mueller et al. | |
| 2005/0047134 | A1 | 3/2005 | Mueller et al. | |
| 2005/0151489 | A1 | 7/2005 | Lys et al. | |
| 2005/0236998 | A1 | 10/2005 | Mueller et al. | |
| 2005/0248299 | A1 | 11/2005 | Chemel et al. | |
| 2006/0076908 | A1 | 4/2006 | Morgan et al. | |
| 2006/0098077 | A1 | 5/2006 | Dowling et al. | |
| 2006/0109649 | A1 | 5/2006 | Ducharme et al. | |
| 2006/0158881 | A1 | 7/2006 | Dowling et al. | |
| 2006/0245174 | A1 | 11/2006 | Ashdown et al. | |
| 2006/0290624 | A1 | 12/2006 | Ashdown et al. | |
| 2006/0291199 | A1 | 12/2006 | Qian et al. | |
| 2007/0115658 | A1 | 5/2007 | Mueller et al. | |
| 2007/0115665 | A1 | 5/2007 | Mueller et al. | |
| 2007/0153514 | A1 | 7/2007 | Dowling et al. | |
| 2007/0195525 | A1 | 8/2007 | Holten et al. | |
| 2007/0195526 | A1 | 8/2007 | Dowling et al. | |
| 2007/0206375 | A1 | 9/2007 | Piepgras et al. | |
| 2007/0230159 | A1 | 10/2007 | Cortenraad et al. | |
| 2007/0258240 | A1 | 11/2007 | Ducharme et al. | |
| 2007/0273290 | A1 | 11/2007 | Ashdown et al. | |
| 2008/0012506 | A1 | 1/2008 | Mueller et al. | |
| 2008/0013314 | A1 | 1/2008 | Ashdown et al. | |
| 2008/0068839 | A1 | 3/2008 | Matheson et al. | |

* cited by examiner

SYSTEM, METHOD AND TOOL FOR OPTIMIZING GENERATION OF HIGH CRI WHITE LIGHT, AND AN OPTIMIZED COMBINATION OF LIGHT EMITTING DIODES

FIELD OF THE INVENTION

The present invention relates to combinations of light emitting diodes for generating white light, and specifically to optimization of light emitting diodes for generating white light with high color rendering index. More particularly the present invention relates to a system, method, tool and an optimized combination of light emitting diodes for generating white light.

BACKGROUND OF THE INVENTION

In the early $20^{th}$ century, a new type of semiconductor junction was produced. The semiconductor junction herein referred to is a diode that is capable of producing light; this type of diode is now commonly known as a Light Emitting Diode (LED). LEDs have been in commercial use for several decades. Initially they were used as indicators in electronic devices such as in television sets, radios, telephones, etc. Essentially in the beginning, commercially available LEDs had weak luminous flux compared to conventional light sources, and their luminous flux was insufficient to provide adequate lighting for illuminating an area, which incandescent lighting was excellent at providing.

The development of LEDs has continued and progressed, and researchers have progressively come up with LEDs with greater luminous flux. In fact, they could now be used in all kinds of lighting applications whereas in the past only conventional light sources were applicable. As a result, they are slowly but surely replacing conventional light sources such as found in flashlights, car lights, traffic signalization, etc.

The principal advantages of the LED over many other types of lighting are: its low energy consumption, and its long life span, which in general extends to fifty thousand hours or more. Although LEDs have been improved to provide greater luminous flux, their use for general lighting is not that extensively accepted by manufacturers and consumers. One of the reasons for its low level of acceptance, as opposed to incandescent lighting, is its lower capacity to provide an acceptable level of color rendering. Color rendering refers to a quantitative measure of the ability of a light source to reproduce colors of various objects faithfully in comparison with an "ideal" source of lighting. Color rendering capability is measured through use of a color rendering index, established by the International Commission on Illumination (CIE).

Incandescent light, for a color temperature range of under 5000K, provides a color rendering index that is optimal. Other sources of light are used as references, for color temperatures of above 5000K. More specifically, on a scale from zero to a hundred, incandescent light has a color rendering index that is equal to one hundred for color temperatures below 5000K. In comparison, white light that is produced by LEDs, typically combine LEDS of various colors including at least combinations of Red Green Blue (RGB). As LEDs' specifications vary from one manufacturer to another, and those specifications vary with the temperature of operation of the LEDs and forward current, it becomes very difficult for lighting manufacturers to integrate LEDs in their domestic applications, as the resulting white light does not render a color rendering index comparable to incandescent light. Thus, notwithstanding the economic and energy savings advantages of LEDs over conventional light sources, lighting manufacturers and domestic consumers do not rely on this technology.

It would therefore be useful to have a tool, method, system and light source that are adapted to optimize use of combination of LEDs for producing white light. It would be a further advantage to identify an optimized combination of LEDs having high color rendering index for "white light" applications.

SUMMARY OF THE INVENTION

The present invention relates to combinations of Light Emitting Diodes (LEDs) for emitting white light, and more particularly to a system, method and tool for optimizing the generation of white light with combinations of LEDs. In another aspect, the present invention also relates to an optimized combination of LEDs for generating white light with high color rendering index.

According to a first aspect, the present invention relates to a system for optimizing combining of Light Emitting Diodes (LEDs). The system comprises a color bin accessing module, an entry module and a processing module. The color bin accessing module is adapted for providing a plurality of LEDs and corresponding specifications. The entry module is adapted for selecting a color temperature (CT) and color rendering index. Then, the processing module calculates for subgroups of LEDs resulting correlated color temperature, resulting color rendering index, resulting luminous flux based on LEDs' specifications, and determines at least one optimized selection of LEDs achieving an optimized luminous flux in accordance to the selected color temperature and color rendering index.

In accordance with another aspect, the present invention relates to a method for optimizing a combination of LEDs. The method includes providing a plurality of LEDs with corresponding specifications and selecting a color temperature (CT) and a color rendering index value. Then, the method calculates for subgroups of LEDs resulting luminous flux, color temperature and color rendering index based on corresponding LEDs' specifications, and identifies at least one combination of LEDs having an optimized corresponding luminous flux according to the selected color temperature and color rendering index.

In accordance to another aspect, the present invention relates to a tool for optimizing white light generated by a combination of LEDs. The tool comprises a repository, a selection module and a processing module. The repository stores specifications for each of the combination of LEDs. The selection module is adapted for selecting at least one of the following parameters: a desired color temperature, a color rendering index, and a maximum shift variance from a black body locus. Then, the processing module calculates for subgroups of LEDs resulting correlated color temperature, color rendering index, and luminous flux based on LEDs' specifications, and identifies an optimized selection of LEDs and corresponding luminous flux for achieving an optimized white light luminous flux in accordance to the at least one selected parameter.

In yet another aspect, the present invention relates to an optimized combination of LEDs for producing white light. The LEDs are from a combination of at least three LEDs comprising one or many of the following colors: red, green, white, amber, cyan and variations thereof, and exclude blue LEDs. The combination of at least three LEDs generates a white light of substantially high color rendering index.

BRIEF DESCRIPTION OF THE DRAWINGS

For a better understanding of embodiments of the system, method, tool, and light source described herein, and to show more clearly how they may be carried into effect, reference will be made by way of example, to the accompanying drawings in which.

DETAILED DESCRIPTION OF THE INVENTION

The present invention relates to a system, method, tool and optimized combinations of Light Emitting Diodes (LED) for generating white light. More particularly, the system and method determine an optimized selection of LEDs for producing a white light of predetermined color temperature(s) based on a set of factors. These factors represent conditions that the system and method take into consideration for optimizing LEDs combination.

The expression "white light" in the context of the present invention is not limited to pure or perfect white light, but rather to white light that can be used to replace current incandescent, fluorescent, halogen lighting. Thus, the "white light" may include some color effect therein, and is not limited to a pure white light.

Figure 2:
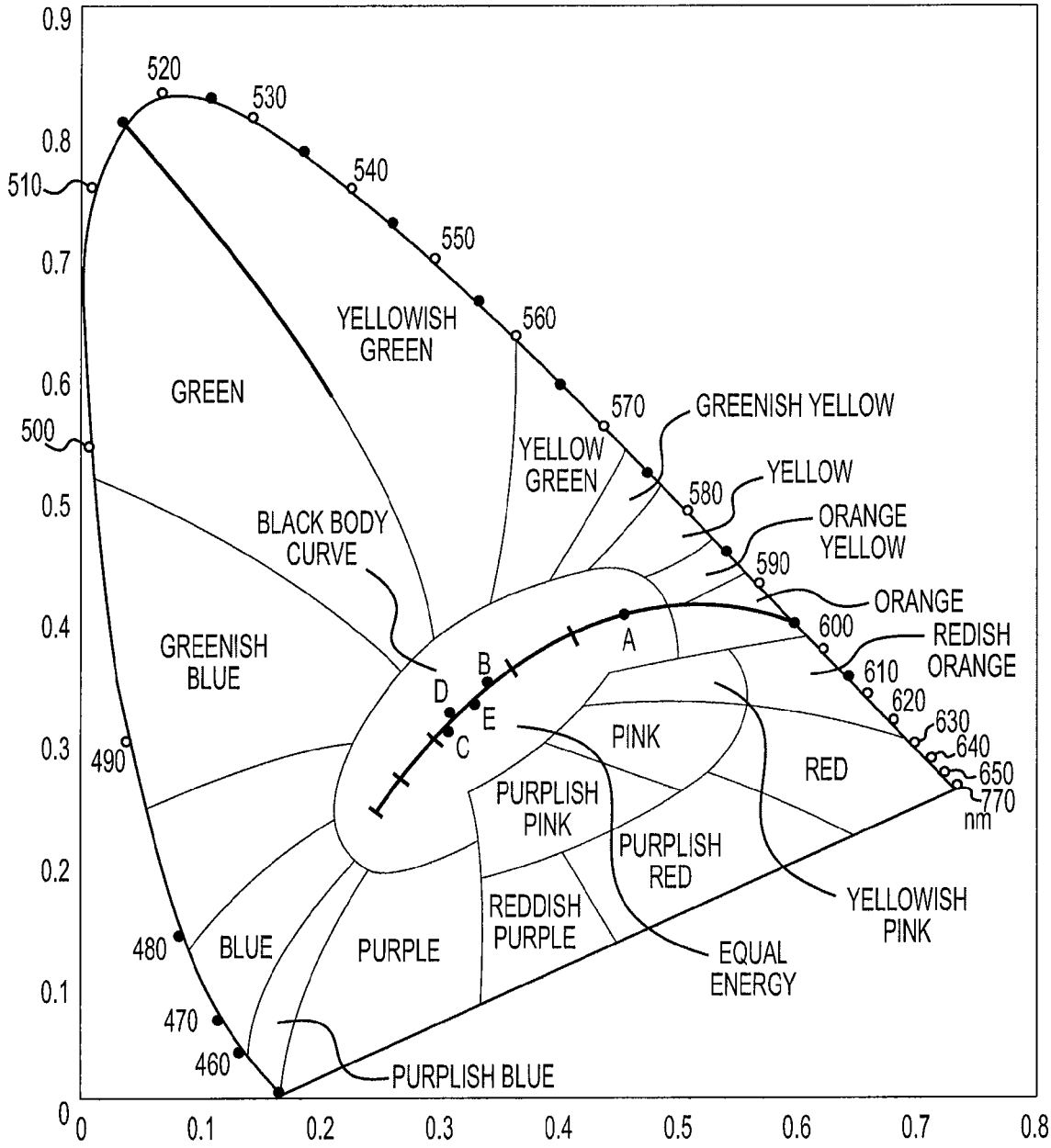
FIG. 2 is a chromaticity diagram in accordance with the CIE 1931 standard colorimetric system.

For sake of clarity, the CIE 1931 International Commission on Illumination xyY space will be used throughout the present specification. In the xyY color space, the colors are represented as x,y coordinates of a chromaticity diagram from the International Commission on Illumination (CIE) 1931 standard colorimetric system, as shown on FIG. 2. This colorimetric system is used widely in many lighting areas such as traffic lights, photography, etc.

However, it should be noted that the other color spaces, such as for example Lab color space, Luv color space, or any other color space could alternately be used without departing from the present invention. However, the equations described herein would need to be adapted to reflect the change of color space.

Combination of LEDs

In the context of the present invention, the expression "combination of LEDs is meant to be interpreted as a plurality of LEDs of various colors, excluding blue LEDs. As blue LEDs have a poor efficacy from a lumen/watt, the present invention teaches away from common belief that blue LEDs are required for generating white light of high color rendering index. The various colors include, without being limited thereto: white and all respective variants thereof, red, green, amber, cyan, and all variants thereof. The combination of LEDs may include at least three such colored LEDs or more. Exemplary combinations include:

red, cyan, amber, white;
cool white, warm white, cyan;
warm white, amber, cyan; and
etc.

System

Figure 1:
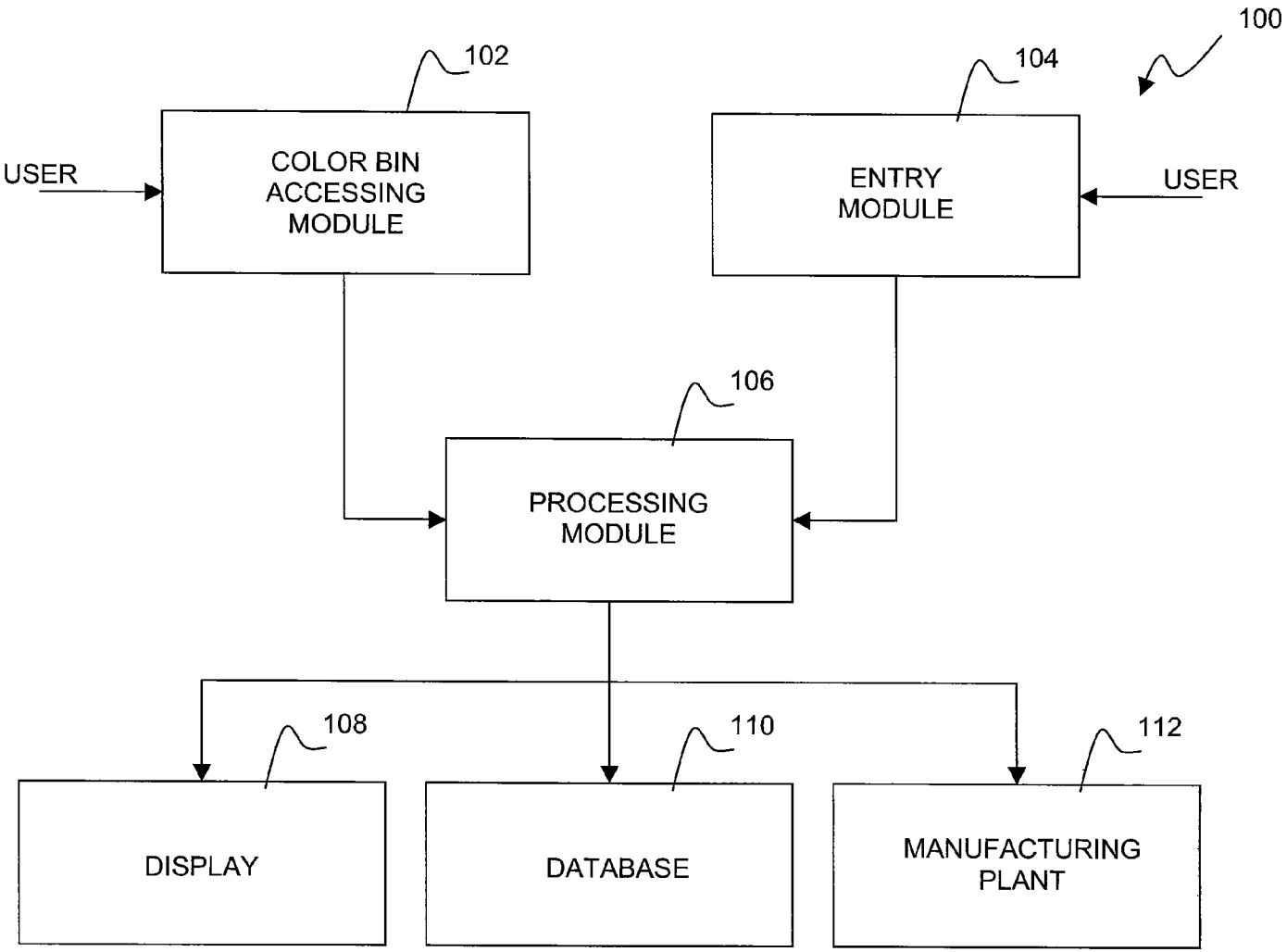
FIG. 1 is a schematic representation of a system in accordance with an aspect of the present invention.

Presented in FIG. 1 is schematic representation of a system in accordance with an aspect of the present invention. The system 100 includes a color bin accessing module 102, an entry module 104 and a processing module 106. The system 100 may further be connected to one or many of the following: a display 108, a database 110 and a manufacturing plant 112.

The color bin accessing module 102 may include or provide access to a repository (not shown) storing information on available LEDs and corresponding specifications. There might be several LEDs from a same manufacturer, or LEDs from various manufacturers in the repository. The repository may be a custom-made database for a particular company's needs, or a standardized database to be used by the LED manufacturers. In an alternate embodiment, the color bin access module provides remote access to LEDs manufacturers repository or websites, to collect information on available LEDs and corresponding specifications.

The specifications of interest for the LEDs comprise: a range of wavelength generated by the LED, a maximum luminous flux, a temperature or a temperature range at which the provided range of wavelength is applicable (also called operating temperature), reel information and corresponding particularities, nominal drive current, forward voltage, flux and color shift vs. temperature and time, etc. Thus, after having accessed the information on available LEDs, the color bin accessing module 102 may further enable a user of the system to select LEDs to be used and transfers the information on the selected LEDs and corresponding specifications to the processing module 106.

The entry module 104 is an interface, which allows a user of the system to select some parameters for the white light to be generated with the combination of LEDs. The possible parameters that may be selected include: a target color temperature for the white light to be generated, an acceptable color shift for the white light to be generated, a target minimum color rendering index, a maximum luminous flux, a maximum number of LEDs, etc.

The target color temperature corresponds to a precise temperature or to a range of temperatures for a white light to be generated, in Kelvin on the black body curve. Ultimately, the target color temperature corresponds to x,y chromaticity coordinates of a chromaticity diagram from the International Commission on Illumination (CIE) 1931 standard colorimetric system. The correlation between the target color temperature and the corresponding x,y coordinates can be performed through use of a lookup table or a database for example. Alternately, the target or range of color temperature(s) could be represented by pre-selected colors, from which a user can make a selection, such as for example: blue white, pink white and yellow white, or incandescent light, fluorescent light, daylight, etc; thus instead of selecting an x,y color coordinate, the color coordinate could be selected from a list of predefined colors, for which corresponding x,y color coordinates and color temperatures are known.

The acceptable color shift corresponds to a tolerated delta from the target color temperature. The target color temperature and acceptable color shift define a target correlated color temperature. The color rendering index is a measure that defines how well colors are rendered by different illuminants in comparison to a standard reference illuminant. The color rendering index is a way of indicating the accuracy level, from zero to a hundred, at which an object's colors are perceivable by human eye, when the object is placed under a light source.

The processing module 106 receives the LEDs' specifications, the target color temperature, the acceptable color shift, the target color rendering index, and any other selected parameters. Based on these parameters, the processing module 106 performs calculations based on the CIE 1931 standard colorimetric system, and more particularly on the CIE XYZ and 1960 uv color spaces equations for subgroups of LEDs to obtain resulting color rendering index, resulting white light luminous flux, etc. Through those calculations, the processing module determines at least one optimized selection of LEDs and corresponding luminous flux, according to the target color temperature, the target minimum color rendering index and the LEDs specifications. The equations used to perform these calculations will be described further. The calculations are performed for various subgroups of the LEDs. The subgroups include subsets of LEDs, and one of the subgroup may include all the LEDs simultaneously.

Figure 3:
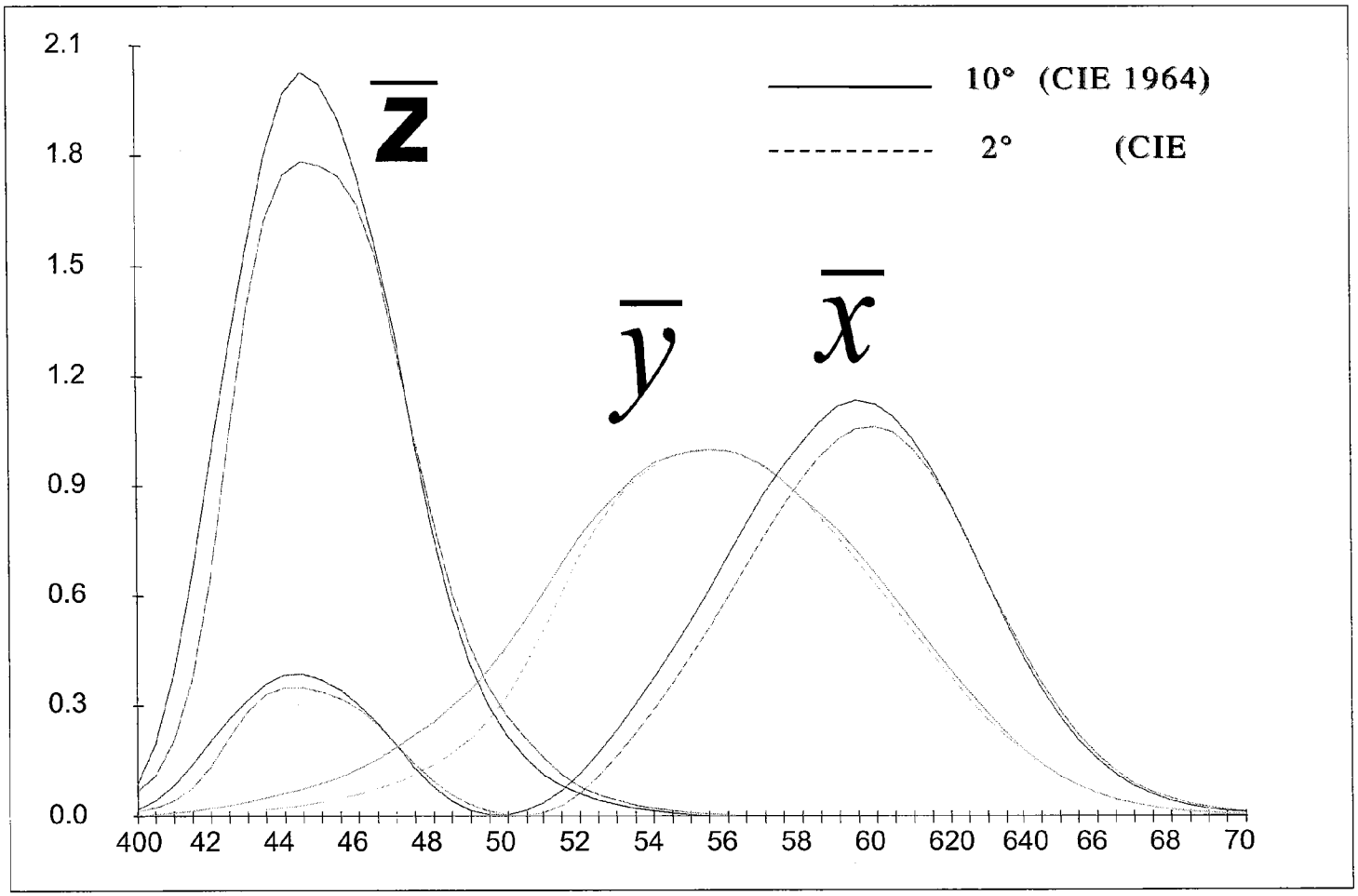
FIG. 3 is a graph depicting the human perception of colors.

According to the CIE 1931 standard colorimetric system, colors are perceived by human eye following specific color curves, shown on FIG. 3. Thus to take into account human perception in the definition of colors, equations have been developed to define the tristimulus values of colors, as perceived by human eye:

$$X=\int\Phi_e(\lambda)\bar{x}(\lambda)d\lambda$$

$$Y=\int\Phi_e(\lambda)\bar{y}(\lambda)d\lambda$$

$$Z=\int\Phi_e(\lambda)\bar{z}(\lambda)d\lambda$$

$$x=X/(X+Y+Z)$$

$$y=Y/(X+Y+Z)$$

$$z=Z/(X+Y+Z)$$

where:

$$x+y+z=1$$

and:

$$X=Y*x/y$$

Y=Y=lumens $$Z=Y*z/y=Y*(1-x-y)/y$$

As tristimulus values are additive, it is possible, knowing the corresponding color coordinates of each LED, and its available luminous flux, to calculate the effect of multiple LEDs, each having its own corresponding tristimulus values, and there from determine overall result. However, such calculations limit the results to identifying the mixed chromaticity and total luminance of selected LEDs, and not to optimize the obtained combination to achieve a target color temperature, and acceptable color shift.

Figure 4:
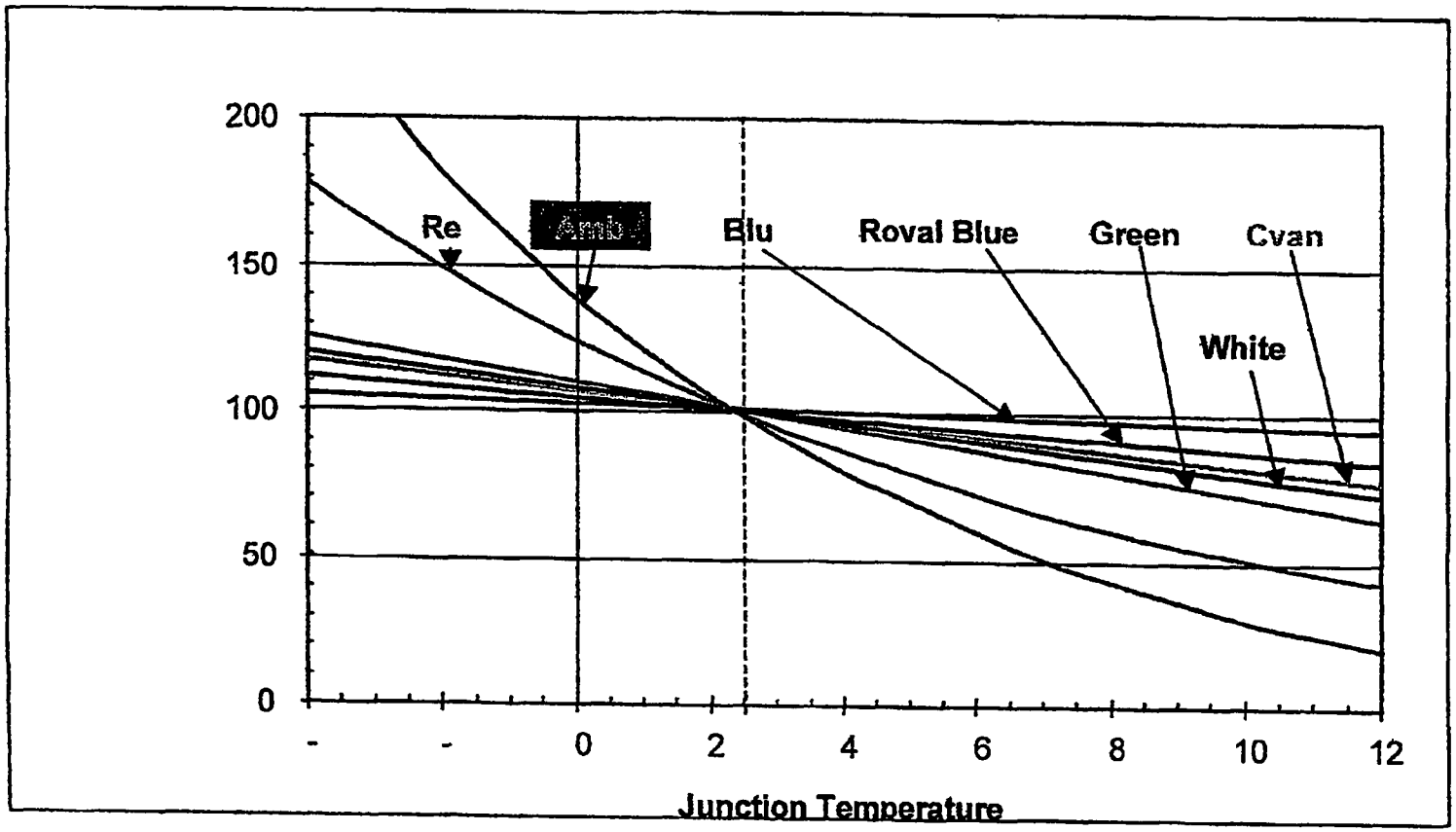
FIG. 4 is a graph depicting the effect of temperature on light output.
Figure 5:
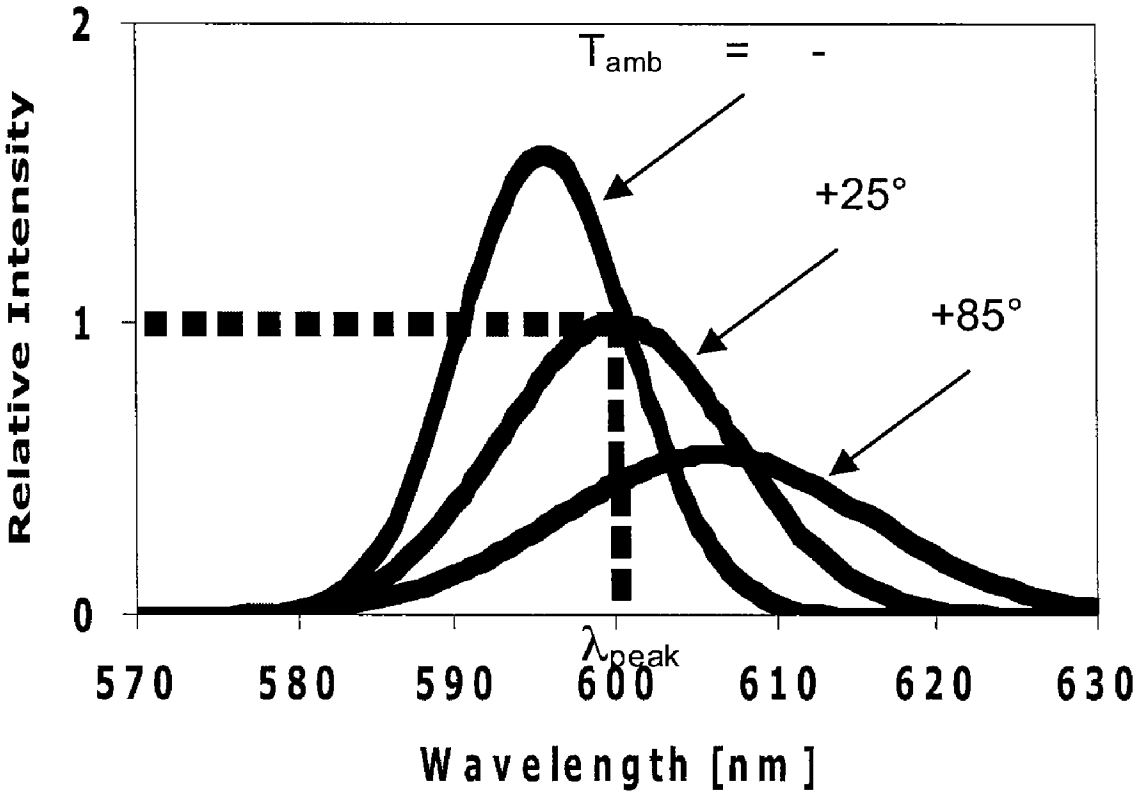
FIG. 5 is a graph depicting the effect of temperature on an amber LED.

In addition to human color perception, other factors have to be taken under consideration when performing calculations by the processing module 106 to optimize combinations of LEDs for generation of white light. Such other factors include the light output versus temperature. Typically, the industry provides specifications for LEDs at an operating temperature (also called junction temperature) of 25° C. However, it is well known in the art that light output varies as a function of temperature, as shown on FIG. 4, and as 25° C. is not a typical operating temperature, the light output provided in data sheets is misleading. Another issue that needs to be addressed by the processing module 106 is the fact that not only light output varies as a function of temperature, but also wavelength. FIG. 5 is a graph representing the effect of temperature on an amber LED. This phenomenon is recognized in the industry, and although simple to resolve independently, the issue becomes more complicated in the context of multiple LEDs for generating white light.

Another factor that also impacts optimizing of generation of white light is the fact that the process of manufacturing LEDs is not an exact science, but rather an approximate process. To facilitate use of LEDs, manufacturers test LEDs and classify the LEDs by placing them on reel of similar specifications. Thus LEDs on a reel have comparable color, voltage and light output, and LEDs from different reels may have significant technical specifications, to be taken into account when performing optimization.

Thus to overcome these problems, the processing module 106 must take under consideration the actual operating temperature at which the selected LEDs must operate, so as to determine actual wavelength and light output, and reel particularities, instead of relying on manufacturers' data sheet alone. The processing module 106 takes under consideration the effects of variants in reels, by relying on u' v' color space (cylindrical coordinates) in accordance with 1960 diagram. u' and v' are perceptually equidistance color space, and can be calculated as follows:

$$u' = \frac{4x}{-2x+12y+3}$$

$$v' = \frac{9y}{-2x+12y+3}$$

$$\Delta u'v' = \sqrt{(u'-u_{center})^2+(v'-v_{center})^2}$$

where the visibility limit is Δu'v'=0.004 and the acceptance limit is Δu'v'=0.008. By computing Δu'v', it is possible to determine whether combined LEDs from different reels will have a visual impact, whether that visual impact will be within acceptable color shift, and take under consideration these variants in the overall calculations.

Based on all these considerations, the processing module then generates a reference illuminant spectral power distribution, generates a test illuminant and calculates for the initial test illuminant: a number of lumens used by each LED to generate the test illuminant, resulting correlated color temperature, corresponding color shift (also called resulting shift from a Planckian black body locus), and resulting color rendering index. The processing module then optimizes the test illuminant based on some or all of the following conditions: number of lumens used does not exceed available flux; maximize number of lumens used from the total available number of lumens; maintain color shift within the selected range, and maintain target minimum color rendering index value selected by changing the number of lumens used by each LED. The generation of the test illuminant may further be an iterative process, where multiple combinations are tested, and the combination having better performances is kept for optimizing. The optimization could also be an iterative process, in which the parameters of the test illuminant are modified one after the other, or in concurrent manner, until an optimized combination of LEDs and parameters are met to achieve the target correlated color temperature, a maximum shift from the Planckian black body locus and the color rendering index are met, with the least LEDs and maximum luminous flux.

When an optimized combination of LEDs and corresponding parameters is identified, the processing module 106 provides the information to at least one of the following: a display 108, a database 110, and a manufacturing plant 112. The display 108 may be a screen on which the optimized combination of LEDs and corresponding parameters is identified, along with a spectral distribution of the optimized combination of LEDs, and details on performed calculations. The database 110 may be a local or remote database in which is stored information on optimal combination of LEDs to achieve target correlated color temperature and specific color rendering index. The manufacturing plant 112 may be a manufacturing facility, adapted to produce light sources made of combined LEDs.

The system of the present invention could thus be implemented as coded hardware, as a software, as a combination of hardware and software, as a remotely accessible software, as locally installed software, and in any other way which would allow a user to make a selection of parameters and optimizing white light produced with a combination of LEDs in according to the selected parameters.

Method

Figure 6:
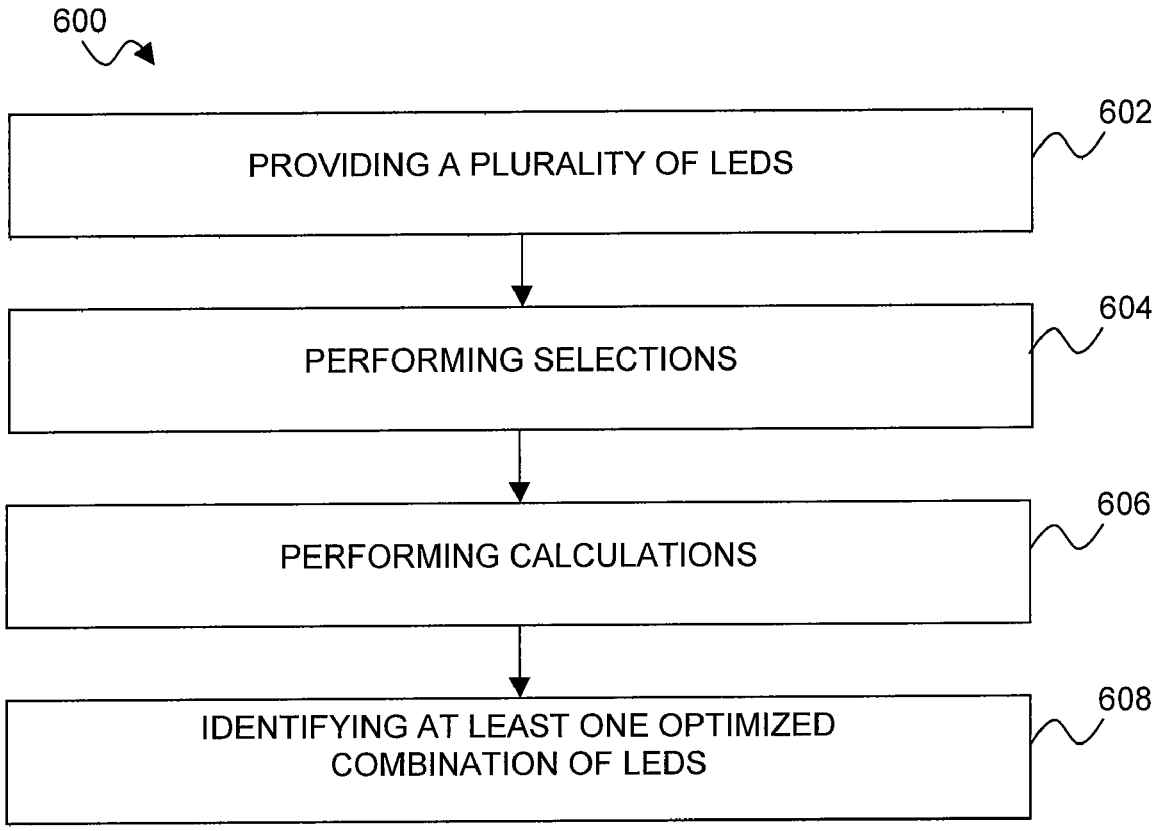
FIG. 6 is a flowchart of a method in accordance with an aspect of the present invention.

Reference is now made to FIG. 6, which depicts a flowchart of a method 600 for optimizing generation of white light from a combination of LEDs in accordance with another aspect of the present invention. The method starts with providing a plurality of LEDs with corresponding specifications 602. The LEDs may be provided from previous selected LEDs, from a lighting source composed of a plurality of LEDs, or from any source or equipment for which optimizing of the generated white light is required. The specifications include some or multiple of the following: flux characteristics, input current, junction temperature, minimum luminous flux (lm) or radiometric power (mW), typical luminous flux (lm) or radiometric power (mW), emitted spectrum (W/nm), peak emission wavelength (nm), emission wavelength half width (nm), relative intensity vs. wavelength, luminous flux vs. forward current, physical dimensions, number of pins, etc.

The method continues with performing selections 604, such as selecting the target color temperature and color rendering index. Various combinations of parameters may be selected and/or may be offered for selection. Examples of such parameters include: target minimum color rendering index, target color temperature, acceptable color shift from a Planckian black body locus, maximum lumens to be used from each LED, maximum number of LEDs, operating temperature, etc.

The method continues in 606 with performing calculations based on the selections performed in 604. Multiple calculations must be performed in the context of the present invention to allow identifying at least one optimized combination of LEDs. Those calculations include:

- generating a reference illuminant for the target color temperature and acceptable color shift, using any method and formulas known to people skilled in the art;
- generating a test illuminant and calculate therefore:
  - number of lumens used by each LED to generate the test illuminant;
  - resulting color temperature;
  - resulting color shift; and
  - resulting color rendering index;
- optimize the test illuminant based on the following conditions:
  - number of lumens used does not exceed available luminous flux;
  - maximize the number of lumens used from the total available number of lumens;
  - maintain color shift within the acceptable range provided; and
  - maintain target minimum color rendering index value by changing the number of lumens used by each LED.

The generating of the reference illuminant (SPD_REF) for the target color temperature is performed using known equations.

Then, the chromaticity coordinates $X_rY_rZ_r$ and $x_r,y_r$ are calculated for the reference illuminant SPD_REF using the following equations:

$$X_r = \int_{380}^{780} \text{SPD_REF}(\lambda)\bar{x}(\lambda)\,d(\lambda)$$

$$Y_r = \int_{380}^{780} \text{SPD_REF}(\lambda)\bar{y}(\lambda)\,d(\lambda)$$

$$Z_r = \int_{380}^{780} \text{SPD_REF}(\lambda)\bar{z}(\lambda)\,d(\lambda)$$

$$x_r = \frac{X}{X+Y+Z}$$

$$y_r = \frac{Y}{X+Y+Z}$$

Then, the colorimetric data is transformed to u,v coordinates of the 1960 diagram, which corresponds to a cylindrical color system, using the following equations:

$$u_r = \frac{4X_r}{X_r + 15Y_r + 3Z_r}$$

$$v_r = \frac{6Y_r}{X_r + 15Y_r + 3Z_r}$$

For the selected LEDs, the test illuminant SPD_TEST is generated. For doing so, the overall corresponding CIE 1931 $X_k$, $Y_k$, $Z_k$ and ($x_k$, $v_k$) chromaticity coordinates are calculated. The calculations of the chromaticity coordinates of the test illuminant take under consideration when applicable effects of temperature on light output, on wavelength, and reel particularities by correspondingly adjusting the resulting x,y color coordinates for each selected LED. Then, the chromaticity coordinates of each selected LED are added, and the overall tristimulus values are calculated therefore to obtain the test illuminant. Alternatively, the test illuminant could be generated by using a subset of the selected LEDs, and sequentially, performing calculations for all possible combinations of selected LEDs, until a combination closest to the desired color temperature is identified. As the tristimulus values are additive, the $X_k$, $Y_k$, $Z_k$ and ($x_k$, $v_k$) chromaticity coordinates are calculated by adding weighted (based on lumens emitted) corresponding values of the LEDs used for the test illuminant. In addition to the $X_k$, $Y_k$, $Z_k$ and ($x_k$, $v_k$) chromaticity coordinates, the $u_k$,$v_k$ coordinates of the 1960 diagram are also calculated for the test illuminant. The equations used to perform those calculations are the tristimulus values equations and 1960 diagram previously described.

To account for the adaptive color shift due to the different state for chromatic adaptation of the test illuminant to be tested (k) and under the reference illuminant (r), the following equations are used:

$$u'_{k,i} = \frac{10.872 + 0.404\frac{c_r}{c_k}c_{k,i} - 4\frac{d_r}{d_k}d_{k,i}}{16.518 + 1.481\frac{c_r}{c_k}c_{k,i} - \frac{d_r}{d_k}d_{k,i}}$$

$$v'_{k,i} = \frac{5.52}{16.518 + 1.481\frac{c_r}{c_k}c_{k,i} - \frac{d_r}{d_k}d_{k,i}}$$

where: i is the color sample index (1-8);

k refers to the test illuminant;

r refers to the reference illuminant; and $$c = \frac{1}{v}(4 - u - 10v)$$

$$d = \frac{1}{v}(1.708v + 0.404 - 1.481u)$$

The variables $u'_{k,i}$ and $v'_{k,i}$ are the chromaticity coordinates of the test illuminant color sample i taking under consideration the adaptive color shift obtained by moving the test illuminant to the reference illuminant SPD_REF, i.e. $u'_k=u_r$ and $v'_k=v_r$.

The chromaticity coordinates $u'_{k,i}$ and $v'_{k,i}$ must then be transformed to a CIE 1964 Uniform Color Space coordinates, which transforms cylindrical coordinates $u'_{k,i}$ and $v'_{k,i}$ into rectangular coordinates, using the following equations:

$$W^*_{r,i}=25(Y_{r,i})^{1/3}-17$$

$$U^*_{r,i}=13W^*_{r,i}(u_{r,i}-u_r)$$

$$V^*_{r,i}=13W^*_{r,i}(v_{r,i}-v_r)$$

$$W^*_{k,i}=25(Y_{k,i})^{1/3}-17$$

$$U^*_{k,i}=13W^*_{k,i}(u'_{k,i}-u'_k)$$

$$V^*_{k,i}=13W^*_{k,i}(v'_{k,i}-v'_k)$$

where: the values $u'_k=u_r$ and $v'_k=v_r$ are the chromaticity coordinates of the test illuminant after consideration of the adaptive color shift.

Then, the values $Y_{r,i}$ and $Y_{k,i}$ must be normalized so that $Y_r=Y_k=100$. The following equations are used to perform the normalization:

$$Y_{k,i} = Y_i \times Y_{knormal}$$

$$Y_{knormal} = \frac{100}{Y_{(SPD_REF)}}$$

$$Y_{r,i} = Y_i \times Y_{mormal}$$

$$Y_{mormal} = \frac{100}{Y_{(SPD_TEST)}}$$

where $Y_i$ is calculated for each color sample independently. Then, the difference between the perceived color of a sample i of the test illuminant k and a sample i of the reference illuminant r is calculated as follows:

$$\Delta E_i = \sqrt{\begin{matrix}(U^*_{r,i} - U^*_{k,i})^2 + \\ (V^*_{r,i} - V^*_{k,i})^2 + \\ (W^*_{r,i} - W^*_{k,i})^2\end{matrix}}$$

Finally, the color rendering index for each sample is calculated using the following equation:

$$R_i=100-4.6\Delta E_i$$

and the overall color rendering index is calculated for all the samples i using an arithmetical mean as follows:

$$R_a = \frac{1}{8}\sum_{i=1}^{8} R_i$$

Then, the method proceeds to optimizing the test illuminant, so as to improve the obtained color rendering index or luminous flux used, or both combined, by varying one or multiple parameters such as the luminous flux, until an optimized test illuminant is obtained. After varying one or multiple parameters, calculations are performed for the modified test illuminant, until an optimum test illuminant is identified 608. The optimized test illuminant corresponds to the optimized combination of LEDs and corresponding luminous flux to reach the desired selected parameters.

The method could alternately pursue with displaying the optimized combination of LEDs and corresponding specifications, or storing the optimized combination of LEDs in a database, or providing the optimized combination of LEDs to a manufacturing plant or proceeding with generating optimized white light in accordance with the identified combination of LEDs and corresponding luminous flux.

Figure 7:
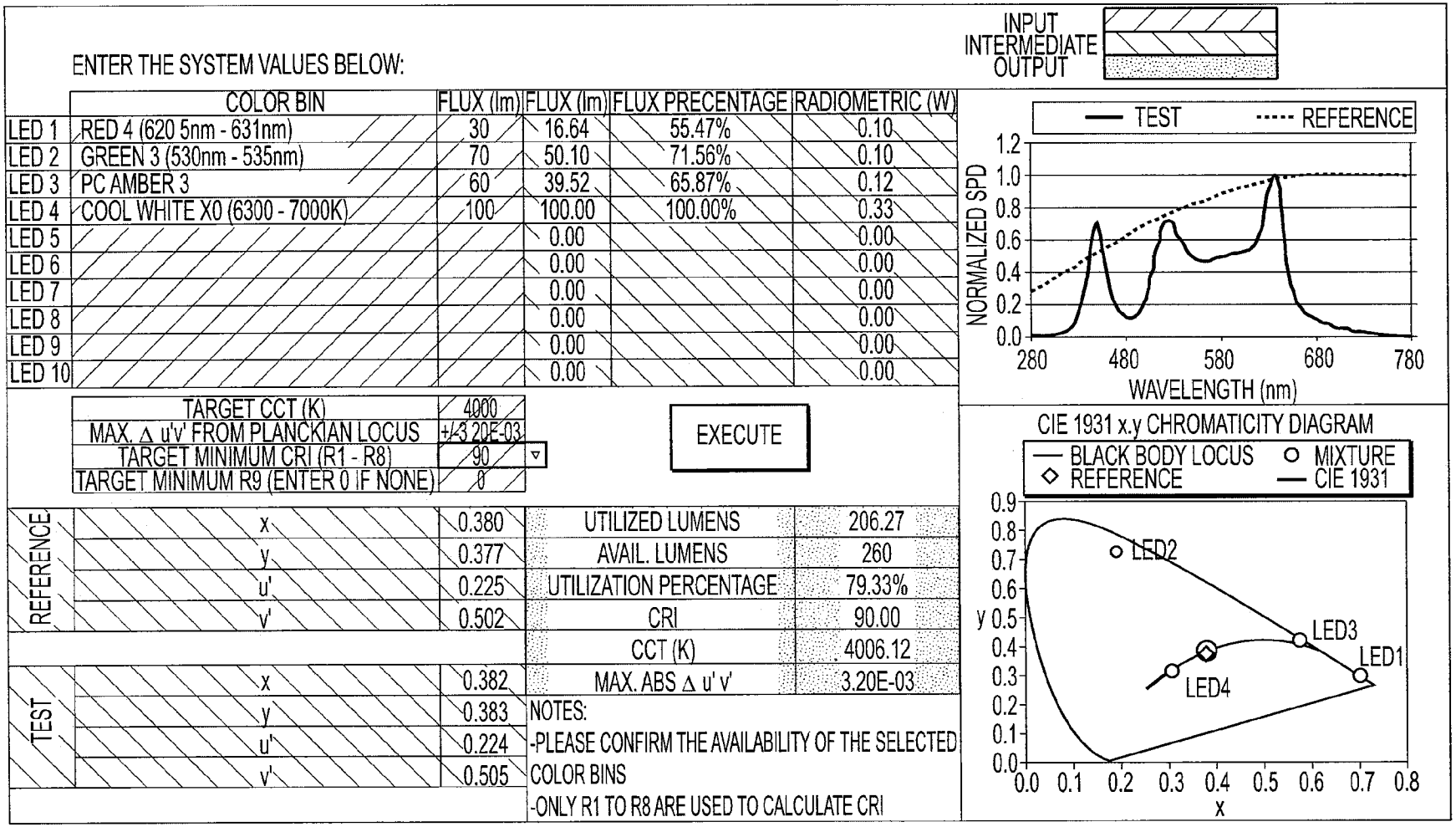
FIG. 7 is an exemplary representation of a display in accordance with an aspect of the present invention.

In the event that the optimized combination of LEDs is displayed, an example of such a possible display is depicted in FIG. 7. The display comprises a selected LED table 702, which in turn comprises LED specifications such as a color field 704, a luminous flux 706, and corresponding chromaticity chart coordinate 708. The display may further include a mixing result table 710 of the selected LEDs. According to an embodiment, the mixing result table 710 comprises a resulting luminous flux field 712, an achieved color rendering index field 714, correlated color temperature, total luminous flux and a resulting chromaticity chart coordinate field. A spectral power distribution (SPD) graph 718 comparing the reference illuminant with the optimized combination of LEDs may further be depicted. Many other fields could further be included in the display, such as an "R" value selector, and a maximum shift variance from a Planckian Black Body Locus.

The system and method of the present invention could further allow displaying of the better performing optimized combinations of LEDs, so as to allow a user to select a preferred combination, based on other criteria not already considered.

Optimized Combination of LEDs

Typically, in the LED industry, white light is generated by combining four LEDs of the following colors: red, green, blue and white (rgbw), or red, green, blue and amber. However, by using the system of the present invention, it could be appreciated that although creating white light, such combination of LEDs is not optimized. By use of the method and system of the present invention, it has been appreciated that other combinations of LEDs provide much better results and are more optimal from a color temperature, color rendering index and total luminous flux, than the traditional rgbw combination. These new optimized combinations, which are also another aspect of the present invention, are composed of a combination of at least three LEDs comprising one or many of the following colors: red, green, white, amber, cyan and variants thereof. However, the combinations of LEDs of the present invention exclude blue LEDs, which have poor efficacy from a lumen/watt aspect. The new optimized combinations further generate white light of substantially high color rendering index (>85), optimized luminous flux and visually undetectable shift variance from a Planckian black body locus.

For doing so, the present invention creates a white point on or around the black body locus using 3 or more LEDs, excluding blue LEDs which are not efficient from a lumen/watt perspective. Delta u'v' is used hereinafter to describe the maximum shift of the white point created with respect to the black body curve. It represents the radius of a circle centered on the black body curve. The LEDs color combinations include for example, without being limited thereto:

Examples of 3-Color Combinations:

Cool-white, warm-white, cyan; or

Warm-white, neutral-white, amber.

Using these combinations, it is possible to achieve a CRI higher than 90. The CCT range covered by these combinations is from 2800K to 5500K. Delta u'v' can vary from 0 to 0.0052.

Examples of 4-Color Combinations:

Red, green, amber, cool-white;

Red, cyan, amber, cool-white;

Red, green, amber, neutral-white; and

Red, cyan, amber, neutral-white.

Using these combinations, it becomes possible to achieve a CRI higher than 90. The CCT range covered by these combinations is from 2800K to 5500K. Delta u'v' can vary from 0 to 0.0052.

In the LED color combination options, the CCT range covered by warm-white LEDs is from 2605K to 3500K, neutral-white LEDs is from 3500K to 4500K and cool-white LEDs is from 4500K to 10000K.

The circle created by the delta u'v' is related to MacAdam Ellipses as it creates a region around a center white point on the black body curve. Any white point falling within this region is indistinguishable to the human eye. The advantage that is gained by varying delta u'v' appears in the CRI and the lumen utilization efficiency of the system. For example, when delta u'v' is 0, the white point is created right on the black body curve. To do so, the system doesn't utilize all the available lumens because of the strict constraint on the location of the white point. In addition, the system limits the CRI value. On the other hand, if delta u'v' is 0.0052, as an example, the white point can be anywhere around the black body curve within a circle of 0.0052 radius. This circle is centered at the color temperature point specified by the user on the black body curve. In this case, the constraint on the location of the white point is more relaxed and the system can utilize more of the available lumens to create the white point, hence, higher efficiency. Higher CRI value can be achieved as well. Delta u'v' can be increased beyond 0.0052 depending on the application and is not limited to 0.0052.

To illustrate the present invention, the following LED color combination is considered: cool-white, warm-white, cyan. The white color point is created at CCT=2900K. When delta u'v' is selected to be 0, CRI is below 90. When delta u'v' is changed to 0.0052, CRI increases to above 90 and the lumens utilization percentage increases by 10%.

Figure 8:
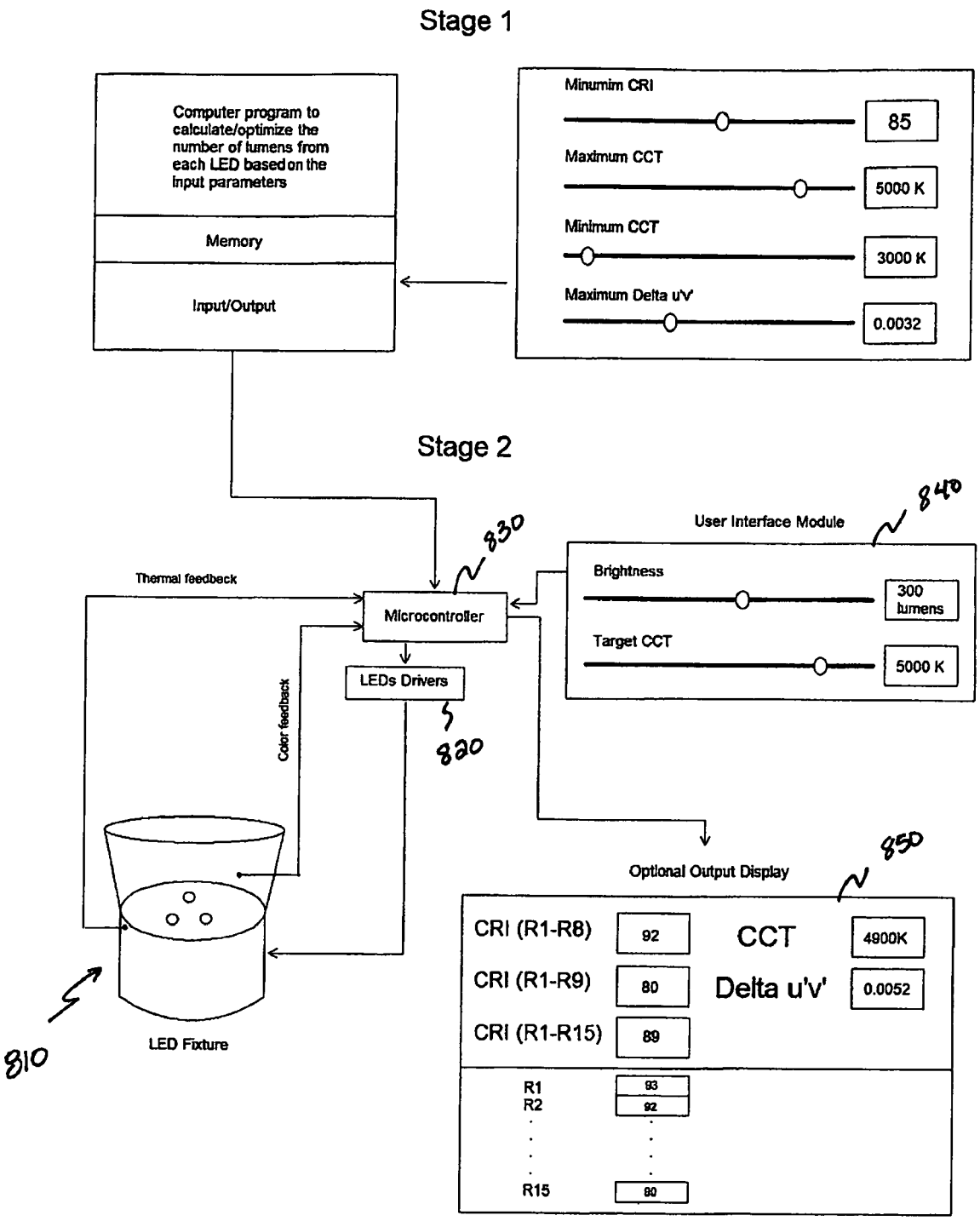
FIG. 8 is a schematic representation of another system in accordance with yet another aspect of the present invention.

Reference is now made to FIG. 8, which represents a 3-LED combination that could be used as a LED down light. The represented LED fixture 810 consists of 3 LEDs, a heat sink and a color mixing optic. Drivers' circuitry 820 could be external or internal to the LED fixture 810 depending on the available space and application.

FIG. 8 is divided in 2 stages: a luminous flux optimization stage (stage 1), and a controlling stage (stage 2). The flux optimization stage implements the previously described principles, by which, based on selected color rendering index, minimum and maximum color temperatures and acceptable color shift, an optimized luminous flux is calculated for the 3 LEDs. The optimized flux for each LED determined to achieve the optimized luminous flux is then provided to the LEDs drivers 820 either directly or through a microcontroller 830. The microcontroller may further receive user's preferences (such as brightness or target color temperature) from a user interface module 840. An optional output display may further be provided to detail the characteristics of the optimized luminous flux, such the color rendering index for various ranges of R, the correlated color temperature and the color shift.

The microcontroller 830 is thus adapted to provide the LED drivers 820 with the information needed on the driving conditions of each LED using pulse width modulation (PWM), pulse density modulation (PDM), pulse code modulation (PCM), stochastic signal density modulation (SSDM) or any other LED controlling method. The microcontroller 830 can additionally be connected to thermal and/or optical sensors to provide feedback information on the white color point created to ensure stability over time. Once the feedback sensors detect a color shift or a color rendering index shift caused by a change in the dimming ratios of each LED, they will send a signal to the microcontroller that will execute a sequence of events that will ensure restoring the original color point and CRI. This sequence of events may include but not limited to activating a cooling mechanism or lowering the relative dimming ration of the LEDs combination. The microcontroller 830 is also optionally connected to the user interface module 840 by which the user can select the brightness of the white color created by the LEDs combination and set the target correlated color temperature from the range pre-loaded to the microcontroller 830 from stage 1. This user interface module 840 may consist of capacitive sensing modules, sliders, buttons or other method to specify brightness and target correlated color temperature. The white point can be dynamically changed by changing the input on the user interface module 840.

When the system of the present invention is to be used for medical applications, stage 1 also calculates the R1 to R15 values including R9 value, which is of interest to the medical market. The R9 value represents how good the light source is in reflecting the true color of strong red. This invention calculates the conventional color rendering index using R1 to R8 values, color rendering index using R1 to R9, color rendering index using R1 to R15 and R9 value separately. In addition, the microcontroller 830 may have an optional output display that may include the following: CRI (R1-R8), CRI (R1-R9), CRI (R1-R15), R9, and the individual values of R1 to R15.

Although the present invention has been described by way of preferred embodiments, the system, method, tool, light source and optimized combination of LEDs are not limited to the embodiments provided herein. The scope of protection of the system, method, tool, light source and optimized combination of LEDs should be interpreted in view of the appended claims.

The invention claimed is:

1. A system for optimizing combination of Light Emitting Diodes (LEDs) comprising:

a color bin accessing module for providing a plurality of LEDs and corresponding LEDs' specifications;

an entry module for selecting a color temperature (CT) and a color rendering index; and a processing module for calculating for subgroups of LEDs resulting color temperature, resulting color rendering index, resulting luminous flux based on LEDs' specifications, and for determining at least one optimized selection of LEDs achieving an optimized luminous flux in accordance to the selected color temperature and selected color rendering index.

2. The system of claim 1, further comprising providing a maximum shift around a black body locus, and the processing module further calculates a resulting shift around a point of the black body locus and determines at least one optimized selection of LEDs in further accordance with the provided maximum shift.

3. The system of claim 1, wherein the entry module is adapted for further entering a maximum acceptable variation of the CT.

4. The system of claim 1, wherein the LED specification is a maximum luminous flux.

5. The system of claim 1, wherein the at least one selected LED specification is a color wavelength range and a maximum luminous flux.

6. The system of claim 5, wherein the at least one selected LED specification further includes an operating temperature.

7. A method for optimizing a combination of Light Emitting Diodes (LEDs), the method comprising:

providing a plurality of LEDs with corresponding specifications;

selecting a color temperature (CT) and a color rendering index value;

calculating for subgroups of LEDs resulting luminous flux and color rendering index based on corresponding LEDs' specifications; and identifying at least one combination of LEDs having an optimized corresponding luminous flux according to the selected color temperature and color rendering index.

8. The method of claim 7, further comprising providing a maximum shift around a black body locus, and wherein the calculating is further based on the maximum shift, and the identifying is further based on the provided maximum shift.

9. The method of claim 8, wherein the LEDs corresponding specifications include color wavelength range, maximum luminous flux and operating temperature.

10. The method of claim 7, wherein the determining further comprises calculating and displaying an achieved color rendering index, CT and total lumens for the at least one optimized selection of LEDs.

11. The method of claim 7, further comprising a step of displaying an achieved spectral distribution for each of the at least one optimized selection of LEDs and for a reference spectral distribution.

12. A tool for optimizing white light generated by a combination of Light Emitting Diodes (LEDs), the tool comprising:

a repository for storing specifications for the combination of LEDs;

a selection module for selecting at least one of the following parameters: a desired color temperature, a color rendering index, and maximum shift variance from a black body locus; and a processing module for calculating for subgroups of LEDs resulting color temperature, resulting color rendering index, resulting luminous flux based on LED$ specifications, and for identifying an optimized selection of LEDs and corresponding luminous flux in accordance to the at least one selected parameter.

13. Use of the tool of claim 12 in a light dimmer.

14. An optimized combination of Light Emitting Diodes (LEDs), comprising:

a combination of at least three LEDs, the at least three LEDs comprising one or many of the following color LEDs: red, green, white, amber, cyan and combinations thereof and excluding blue LEDs, wherein the combination of at least three LEDs generates a white light of substantially high color rendering index; and wherein the combination of at least three LEDs comprises at most one variant of white LEDs.

15. The optimized combination of LEDs of claim 14, wherein the combination of at least three LEDs produces, when excited, a white light with an optimized luminous flux for a predetermined color temperature, and a visually undetectable shift variance from a black body locus.

16. Use of the optimized combination of LEDs of claim 14 in one of the following: surgical light, medical light, headlight, task light, undercabinet light and ambiance light.

17. The optimized combination of LEDs of claim 15, wherein the substantially high color rendering index is above 85.

* * * * *